US012791022B2

(12) United States Patent
Weber et al.

(10) Patent No.: US 12,791,022 B2
(45) Date of Patent: Nov. 10, 2026

(54) FLUID PUMP

(71) Applicant: VALEO EMBRAYAGES, Amiens Cedex (FR)

(72) Inventors: Patrick Weber, Ebern (DE); Rolf Seidl, Ebern (DE); Manuel Merkle, Ebern (DE); Julian Wiesner, Ebern (DE); Andre Buehling, Ebern (DE); Roland Stoessel, Ebern (DE)

(73) Assignee: VALEO EMBRAYAGES, Amiens (FR)

( * ) Notice: Subject to any disclaimer, the term of this patent is extended or adjusted under 35 U.S.C. 154(b) by 0 days.

(21) Appl. No.: 19/087,798

(22) Filed: Mar. 24, 2025

(65) Prior Publication Data

US 2025/0320867 A1 Oct. 16, 2025

(30) Foreign Application Priority Data

Apr. 11, 2024 (DE) ..... 102024110150

(51) Int. Cl.
*F04C 2/10* (2006.01)
*F04C 15/00* (2006.01)

(52) U.S. Cl.
CPC ..... *F04C 2/103* (2013.01); *F04C 15/0065* (2013.01); *F04C 2240/40* (2013.01); *F04C 2240/50* (2013.01)

(58) Field of Classification Search
CPC ..... F04C 2/103; F04C 2/086; F04C 2/102; F04C 2/084; F04C 15/0065; F04C 15/0061; F04C 2240/40; F04C 2240/50
See application file for complete search history.

(56) References Cited

U.S. PATENT DOCUMENTS

| | | | | |
|---|---|---|---|---|
| 4,185,717 | A * | 1/1980 | Ford, Jr. | F04C 15/0061 123/196 R |
| 9,309,885 | B2 * | 4/2016 | Blechschmidt | F04C 2/10 |
| 10,060,430 | B2 * | 8/2018 | Ishii | F04C 18/0215 |
| 11,624,365 | B2 * | 4/2023 | Pippes | F04C 2/101 418/181 |
| 2020/0277953 | A1 * | 9/2020 | Terada | F04C 19/007 |
| 2021/0095663 | A1 * | 4/2021 | Yoshimura | F04C 2/102 |

FOREIGN PATENT DOCUMENTS

| | | | |
|---|---|---|---|
| CN | 112112952 | A | 12/2020 |
| DE | 669 696 | A | 1/1939 |
| DE | 100 20 568 | A1 | 10/2001 |
| DE | 10 2005 030 251 | A1 | 1/2007 |

(Continued)

OTHER PUBLICATIONS

Extended European Search Report issued Sep. 9, 2025 in European Patent Application No. 25163540.5, 9 pages.

(Continued)

*Primary Examiner* — Dapinder Singh
(74) *Attorney, Agent, or Firm* — Oblon, McClelland, Maier & Neustadt, L.L.P.

(57) ABSTRACT

A fluid pump including a housing, an internal rotor located in the housing, and an external rotor which surrounds the internal rotor, is rotatably mounted in the housing and, together with the internal rotor, forms a internal gear ring pump. The external rotor is provided with a toothing with which a drive pinion meshes.

11 Claims, 6 Drawing Sheets

(56) References Cited

FOREIGN PATENT DOCUMENTS

Figure 1:
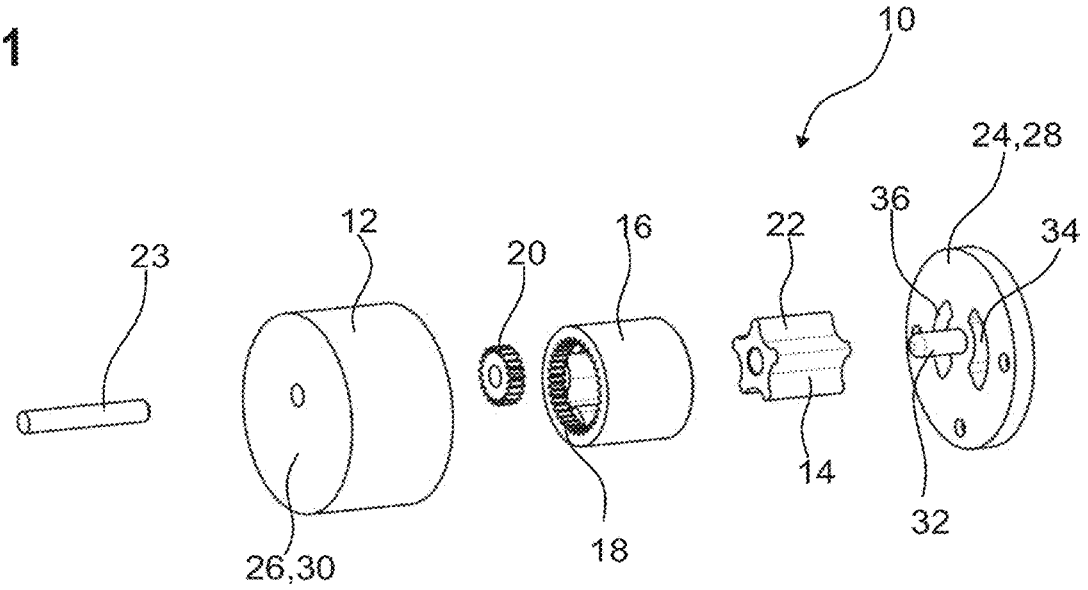

| | | | |
|---|---|---|---|
| DE | 10 2015 214 648 | A1 | 2/2017 |
| EP | 4 407 182 | A1 | 7/2024 |
| JP | 2001-193667 | A | 7/2001 |
| WO | WO 98/21479 | A1 | 5/1998 |

OTHER PUBLICATIONS

German Search Report issued Dec. 5, 2024 in German Application 102024110150.4 filed Apr. 11, 2024, 6 pages (with Written Opinion).

* cited by examiner

FLUID PUMP

The invention relates to a fluid pump comprising a housing, an internal rotor located in the housing, and an external rotor which surrounds the internal rotor, is rotatably mounted in the housing and, together with the internal rotor, forms a internal gear ring pump.

Internal gear ring pumps can be used in particular in motor vehicles for pumping liquid media, such as oil or cooling water.

Usually, in the case of such internal gear ring pumps, the internal rotor is driven by means of a drive motor, in particular by means of an electric motor. In this respect, the internal rotor rotates at the same speed as the drive motor.

In general, if the medium being pumped has a high viscosity, internal gear ring pumps have a disadvantage in efficiency terms, because in this case a higher torque of the drive motor is needed to be able to maintain a constant rotational speed.

For the drive motor, however, a higher rotational speed with as low as possible a torque would be advantageous.

An object of the invention is therefore to specify a more efficient fluid pump for pumping liquid media.

This object is achieved according to the invention by a fluid pump comprising a housing, an internal rotor located in the housing, and an external rotor which surrounds the internal rotor, which is rotatably mounted in the housing and, together with the internal rotor, forms an internal gear ring pump, wherein the external rotor is provided with a toothing with which a drive pinion meshes.

In this way, a transmission mechanism is realized within the fluid pump. This makes it possible for a drive of the fluid pump, in particular an electric motor provided for drive purposes, to be operated in a rotational speed range which has an advantageous effect on the efficiency of the fluid pump. More specifically, the electric motor can be operated at a relatively high rotational speed combined with a low torque.

This makes it possible to operate the fluid pump according to the invention with high efficiency even when a high-viscosity medium is being pumped.

A further advantage of this is that, by operating the electric motor in an optimum rotational speed range, a compact and cost-effective design is possible, since more cost-effective permanent magnets can be used in the electric motor.

The desired transmission ratio from the electric motor to the external rotor can be defined by a corresponding configuration of the drive pinion and the toothing on the external rotor.

According to one embodiment, the toothing of the external rotor is an internal toothing. This contributes to a compact design, because the drive pinion is inside the external rotor.

The drive pinion and the internal toothing of the external rotor can form an internal gear pump. The internal gear pump is in particular a gear mechanism which ensures a reduction in the rotational speed from the electric motor to the external rotor. A particular advantage here, therefore, is that the internal gear pump on the one hand can be used as a transmission mechanism and at the same time as an additional pump stage. This makes it possible to further increase the efficiency of the fluid pump, and a greater volumetric flow can be pumped.

Furthermore, the use of the internal gear pump as an additional pump stage makes it possible to reduce the length of the internal gear ring pump, thereby contributing to a compact design.

A first housing wall, which adjoins the internal rotor, has for example a main inlet opening and a main outlet opening. These openings serve as an intake opening and an outlet opening for the internal gear ring pump. It is optionally also possible for the internal gear pump to draw in liquid via the main inlet opening, in particular when the internal gear ring pump and the internal gear pump are not fluidically separate from one another.

The first housing wall can be formed either by a cover or by a bottom of the housing.

Provided on the first housing wall is in particular a bearing journal for radially mounting the internal rotor, so that the internal rotor can be positioned particularly easily in the housing.

The bearing journal is preferably formed in one piece with the housing wall, as a result of which the number of components is reduced and the assembly of the fluid pump is made easier.

According to one embodiment, a second housing wall, which adjoins the internal toothing of the external rotor, of the housing has an additional inlet opening and an additional outlet opening, which at least partially overlap with the drive pinion. They form an inlet opening and an outlet opening for the internal gear pump, so that the internal gear ring pump and the internal gear pump can pump fluid separately from one another.

For the purpose of fluidic separation between the internal gear ring pump and the internal gear pump, between the internal rotor and the internal toothing of the external rotor there may be an axial wall in the external rotor. This wall is formed preferably integrally in the external rotor.

A second housing wall, which adjoins the internal toothing, of the housing may have a sickle-shaped elevation between the internal toothing of the external rotor and the drive pinion. The sickle-shaped elevation serves to seal off the teeth of the drive pinion and the internal toothing, with the result that it is possible to pump the liquid to be pumped in the two spaces between the tooth gaps of the drive pinion and the internal gear.

The sickle-shaped elevation may also be omitted. In this case, the internal toothing and the pinion act merely as a transmission mechanism, but not for pumping liquid.

According to a further embodiment, the toothing of the external rotor is an external toothing. In this case, the drive pinion is outside the external rotor, and this offers particularly high flexibility in terms of the possible transmission ratio.

For example, a drive shaft extends through the housing and the internal rotor is floatingly mounted on the drive shaft. In this case, therefore, a separate bearing journal for mounting the internal rotor is not necessary, thereby contributing to a straightforward design of the fluid pump.

If the drive pinion is outside the external rotor, the drive pinion may be part of an at least two-stage gear mechanism, as a result of which the transmission ratio between the electric motor and the internal rotor of the internal gear ring pump can be selected with great flexibility.

The drive pinion may have a first toothing and a second toothing axially offset from the first toothing, wherein the first toothing and the second toothing have different numbers of teeth. Such a two-stage gear results in a smaller structural space being taken up.

Preferably the second toothing of the drive pinion extends into the housing, as a result of which the drive pinion can mesh directly with the external toothing of the external rotor, thereby contributing to a compact design.

Moulded on the drive pinion may be a bearing journal, which is radially mounted in the housing. To this end, the housing has a corresponding cutout. The drive pinion is thus stably supported in the radial direction and is reliably held in engagement with the external toothing of the external rotor.

Figure 2:
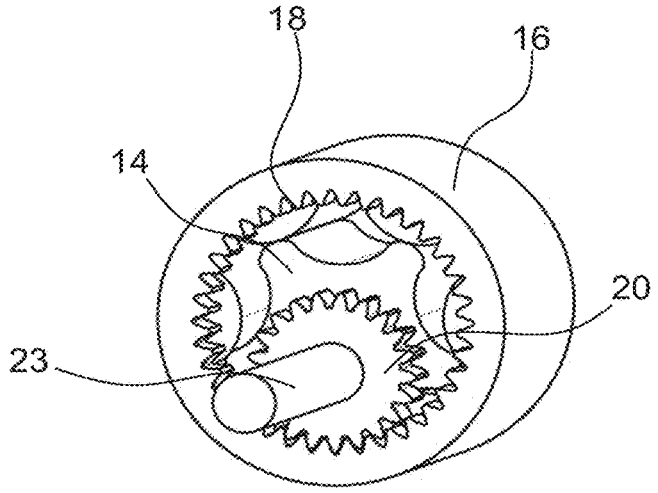
Figure 3:
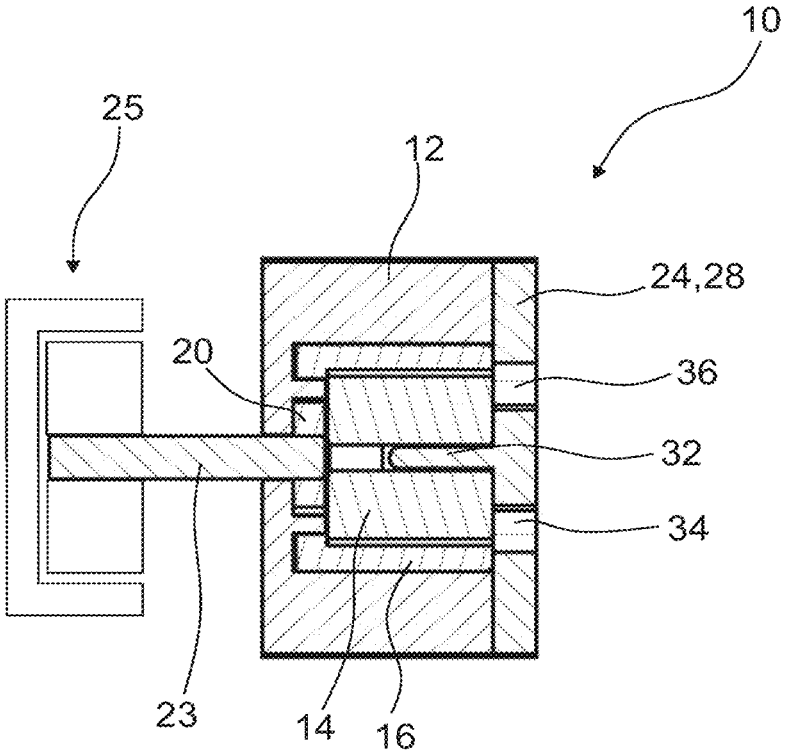
Figure 4:
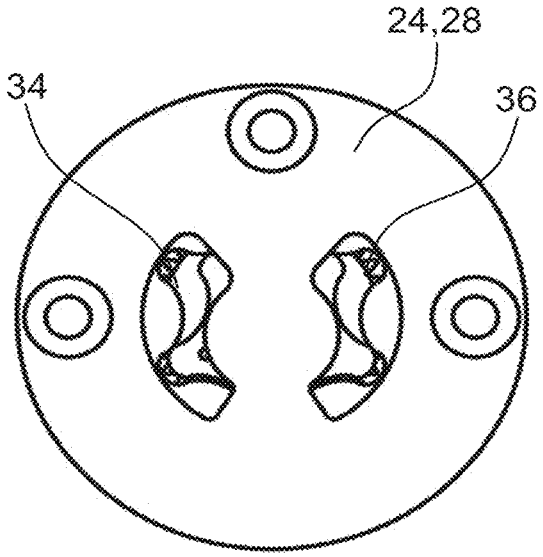
Figure 5:
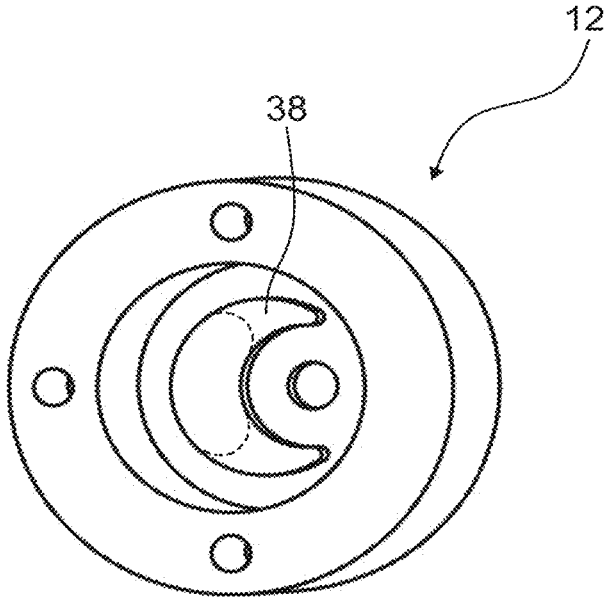
Figure 6:
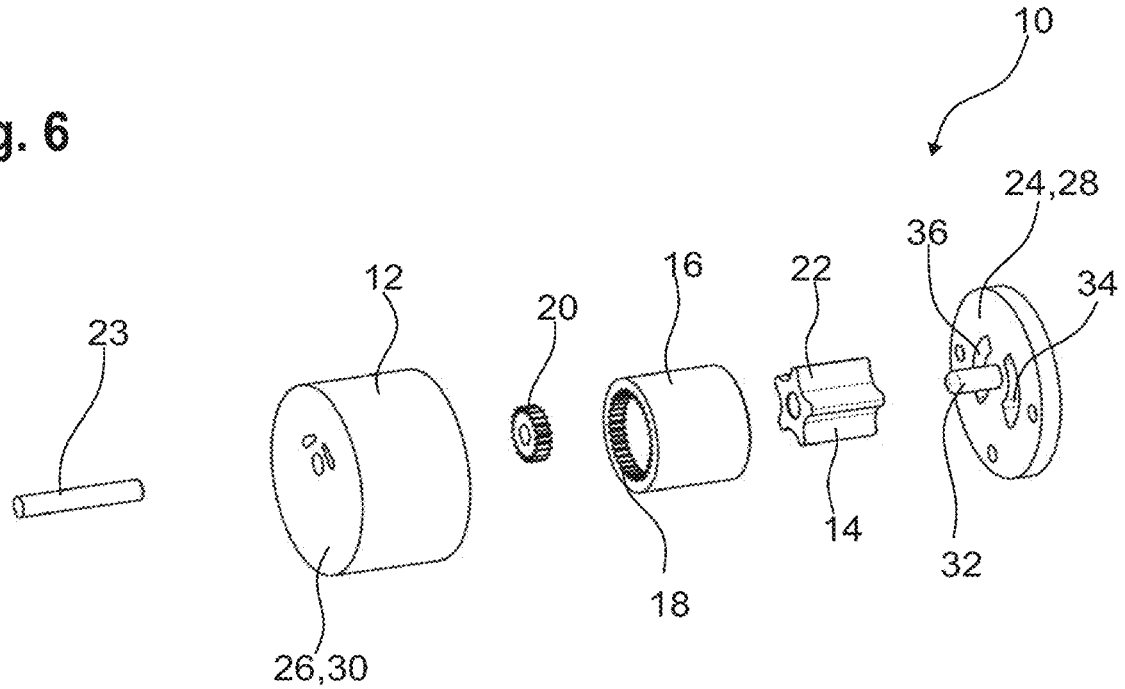
Figure 7:
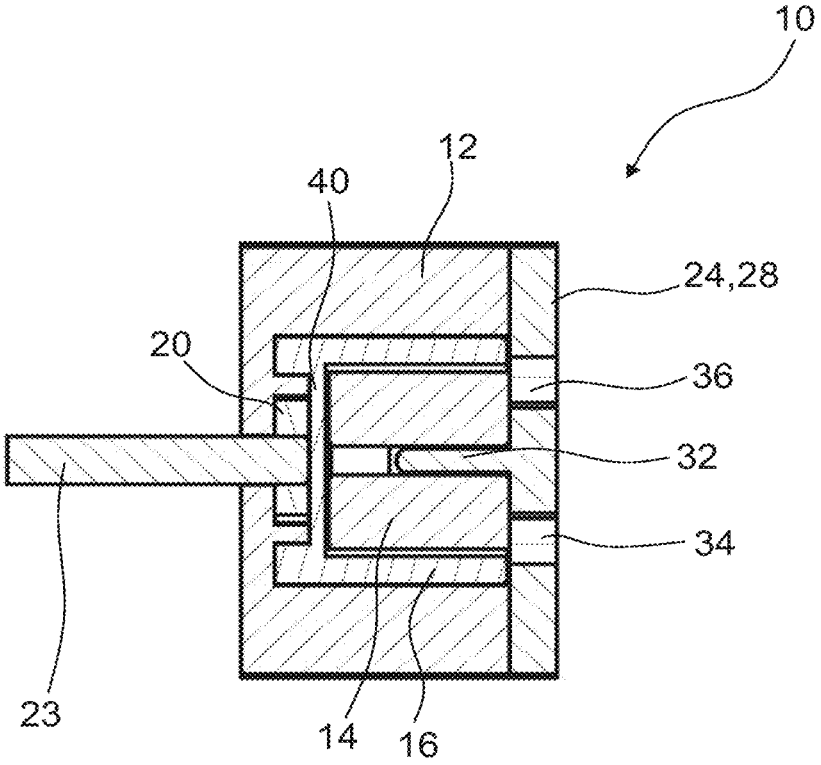
Figure 8:
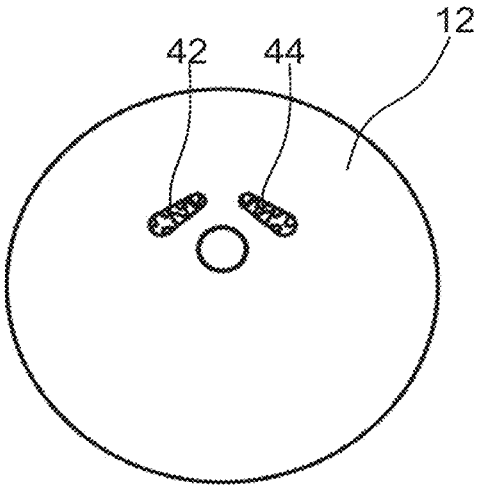
Figure 9:
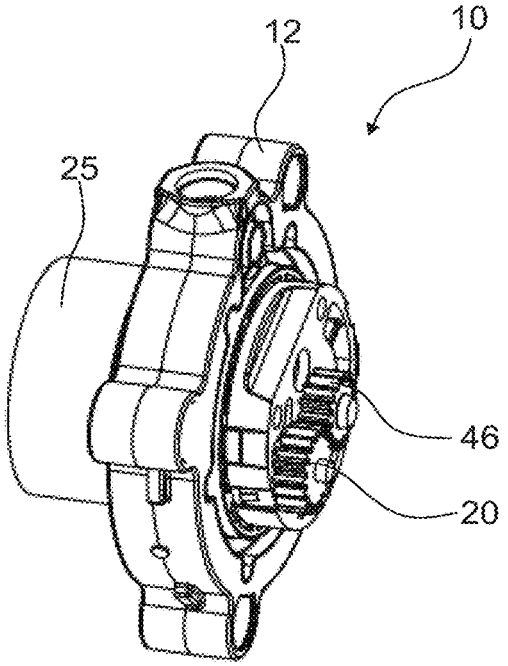
Figure 10:
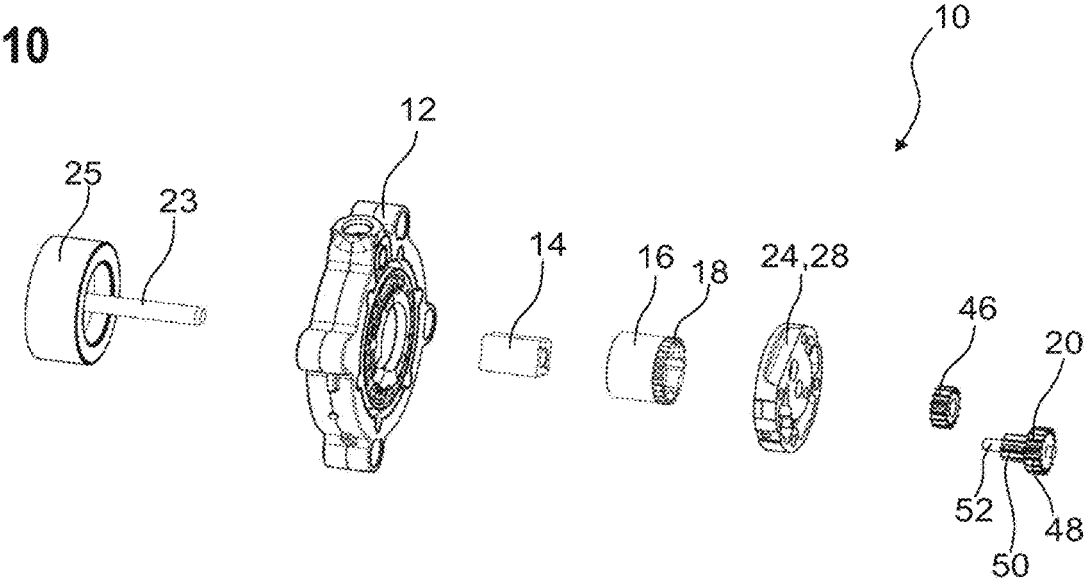
Figure 11:
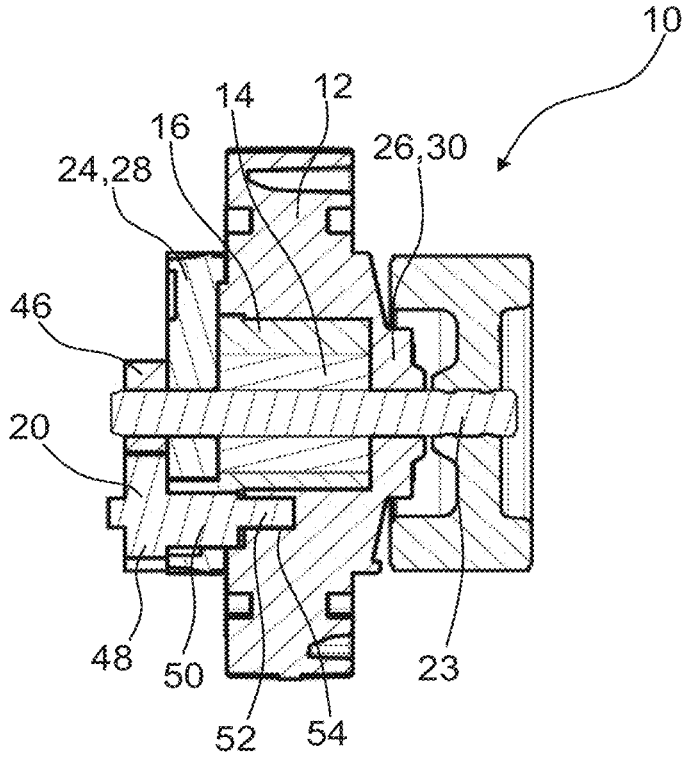
Figure 12:
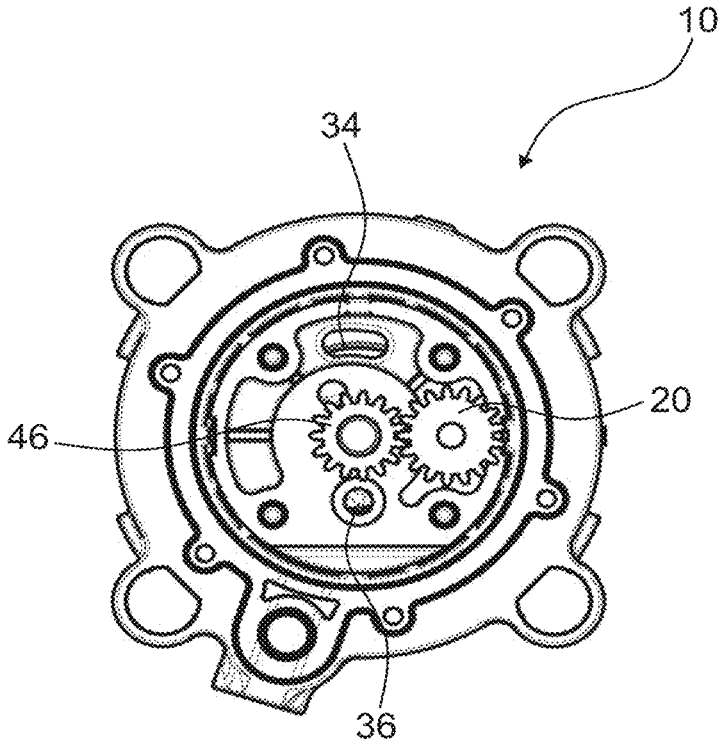

Further advantages and features of the invention can be found in the following description and in the accompanying drawings, to which reference is made. In the drawings:

FIG. 1 shows an exploded representation of a fluid pump according to the invention, FIG. 2 shows a sub-assembly of the fluid pump in FIG. 1, FIG. 3 shows a sectional representation of the fluid pump in FIG. 1, FIG. 4 shows a front view of the fluid pump in FIG. 1, FIG. 5 shows a housing of the fluid pump in FIG. 1, FIG. 6 shows a further embodiment of a fluid pump according to the invention, FIG. 7 shows a sectional representation of the fluid pump in FIG. 6, FIG. 8 shows a rear view of the fluid pump in FIG. 6, FIG. 9 shows a perspective representation of a further embodiment of a fluid pump according to the invention, FIG. 10 shows an exploded representation of the fluid pump in FIG. 9, FIG. 11 shows a sectional representation of the fluid pump in FIG. 9, and FIG. 12 shows a front view of the fluid pump in FIG. 9.

FIG. 1 shows an exploded representation of a fluid pump 10. The fluid pump 10 serves to pump liquid media, for example oil or cooling water.

The fluid pump 10 comprises a housing 12, an internal rotor 14 located in the housing 12, and an external rotor 16 which surrounds the internal rotor 14.

The external rotor 16 is rotatably mounted in the housing 12.

The external rotor 16 and the internal rotor 14 together form a internal gear ring pump. In the exemplary embodiment, the internal gear ring pump is in the form of a gerotor pump. The external rotor 16 thus has inwardly extending projections, and the internal rotor 14 has an outer contour with outwardly extending projections 22, which interact appropriately with the inner contour of the external rotor 16. The mode of operation of such pumps is very well known, and therefore at this juncture a detailed description will be omitted.

The external rotor 16 is provided with a toothing 18, more specifically an internal toothing.

A drive pinion 20 meshes with the toothing 18, as can be seen particularly clearly in FIG. 2. The drive pinion 20 serves to drive the external rotor 16. The drive pinion 20, together with the toothing 18, forms a gear stage of a step-down mechanism, by means of which the rotational speed of a drive shaft 23, on which the drive pinion 20 is fitted for conjoint rotation, can be reduced.

When the external rotor 16 is being driven, it also drives the internal rotor 14 via the mutually interacting projections.

The drive pinion 20 and the internal toothing 18 of the external rotor 16 also form an internal gear pump, which like the internal gear ring pump formed by the internal rotor 14 and external rotor 16 can be used to pump fluid. As FIG. 3 shows, these two pumps are axially next to one another. The drive pinion 20 extends into the external rotor 16 at one axial end thereof, and the remaining axial space of the external rotor 16 is taken up by the internal rotor 14, which thus extends as far as that axial end of the external rotor 16 that is situated opposite the drive pinion 20.

To drive the fluid pump 10, an electric motor 25, shown schematically in FIG. 3, is provided.

The electric motor 25 drives the drive shaft 23, which extends into the housing 12 and on which the drive pinion 20 sits for conjoint rotation.

The drive shaft 23 and thus also the drive pinion 20 are eccentric with respect to the external rotor 16.

The housing 12 has a first housing wall 24, which adjoins the internal rotor 14, and a second housing wall 26, which adjoins the internal toothing 20 of the external rotor 16.

In the exemplary embodiment, the first housing wall 24 is formed by a separate housing cover 28 and the second housing wall 26 is formed by a bottom manufactured integrally with the housing 12. The arrangement shown in the figures of the housing cover and housing bottom can, however, also be inverted.

The first housing wall 24, i.e. the housing cover 28, has a bearing journal 32 which is formed integrally with the first housing wall 24.

The bearing journal 32 serves to radially mount the internal rotor 14.

The axial mounting of the internal rotor 14 is realized by the two housing walls 24, 26, between which the internal rotor 14 is located. This also applies to the external rotor 16.

The first housing wall 24 has a main inlet opening 34 and a main outlet opening 36, as shown in FIGS. 1 and 4.

A side, facing towards the interior space of the housing 12, of the second housing wall 26, i.e. the housing bottom 30, has a sickle-shaped elevation 38, as shown in FIG. 5. In the mounted state, this elevation 38 is located between the internal toothing of the external rotor 16 and the drive pinion 20. It separates the suction side of the gear pump 18, 20 from the pressure side.

While the fluid pump 10 is operating, the internal gear ring pump and the internal gear pump conjointly pump liquid, with the internal gear ring pump and the internal gear pump pumping in the same direction. The internal gear ring pump and the internal gear pump may thus be regarded as separate pump stages of the fluid pump 10.

The reduction in speed from the pinion 20 to the external rotor 16 reduces the rotational speed of the electric motor 25, with for example a ratio of 2:1 or 3:1 being transferred to the internal rotor 14.

The overall step-down ratio from the electric motor 25 to the internal rotor 14 is given by the step-down ratio from the pinion 20 to the external rotor multiplied by the step-down ratio between the external rotor 16 and the internal rotor 14 internal toothed ring.

In the exemplary embodiment according to FIGS. 1 to 5, the main inlet opening 34 and the main outlet opening 36 constitute a common suction opening, or outlet opening, for both pump stages.

The individual constituent parts of the fluid pump, in particular the housing 12, the internal rotor 14, the external rotor 16 and the drive pinion 20, are for example injection moulded parts, in particular plastics injection moulded parts. However, it is also possible for one or more constituent parts to be manufactured from metal.

FIGS. 6 to 8 show a further embodiment of a fluid pump 10.

The fluid pump 10 represented in FIGS. 6 to 8 differs only slightly from the fluid pump 10 represented in FIGS. 1 to 5.

On the one hand, an axial wall 40 is located in the external rotor 16. The wall is in particular integrally formed with the external rotor 16.

The wall 40 is located between the internal rotor 14 and the toothing 18 of the external rotor 16, so that the wall 40 fluidically separates the internal gear ring pump and the internal gear pump from one another.

Therefore, in the embodiment according to FIGS. 6 to 8, in addition to the main inlet opening 34 and the main outlet opening 36, which in this case are assigned to the internal gear ring pump, the second housing wall 26 of the housing 12 has an additional inlet opening 42 and an additional outlet opening 44 formed in it.

The additional inlet opening 42 and the additional outlet opening 44 are assigned to the internal gear pump, so that the latter can take in and discharge liquid, respectively, via the openings 42, 44.

To this end, the additional inlet opening 42 and the additional outlet opening 44 at least partially overlap with the drive pinion 20, as shown in FIG. 8 in which, through the openings 42, 44, a part of the toothing of the drive pinion 20 and a part of the toothing 18 of the external rotor 16 can be seen.

Both in the case of the fluid pump 10 according to FIGS. 1 to 5 and in the case of the fluid pump 10 according to FIGS. 6 to 8, it is feasible for the internal gear pump to be short-circuited, such that it no longer contributes to the volume pumped by the fluid pump 10 but rather serves purely as a transmission mechanism.

In order to short-circuit the internal gear pump, the sickle-shaped elevation can be made smaller or left out entirely.

It is additionally conceivable, in the case of the fluid pump 10 according to FIGS. 1 to 5, to make the sickle-shaped elevation 38 shorter, resulting in a rather kidney-shaped contour of the elevation, as illustrated by the dashed line in FIG. 5. In this case, the internal gear ring pump can take in liquid both via the main inlet opening 34 and via the additional inlet opening 42.

FIGS. 9 to 12 show a further embodiment of a fluid pump 10.

For structures that are the same and have the same functions, which are known from the above embodiment, the same reference signs will be used below, and in this respect reference is made to the explanations given above.

In the following text, only the differences between the respective embodiments will be discussed in order to avoid repetitions.

As is clear from the exploded representation in FIG. 10, the fluid pump 10 according to FIGS. 9 to 11 also comprises a housing 12, an internal rotor 14 located in the housing 12, an external rotor 16 which surrounds the internal rotor 14 and is rotatably mounted in the housing 12, a drive pinion 20, and an electric motor 25.

By contrast to the above-described embodiment, the toothing 18, with which the drive pinion 20 meshes, of the external rotor 16 is an external toothing, as shown for example in FIG. 10.

Moreover, no additional internal gear pump is realized next to the internal gear ring pump.

The drive shaft 23 driven by the electric motor 25 extends through the housing 12.

In particular, on the housing side facing away from the electric motor 25, the drive shaft 23 projects beyond the housing 12, i.e. beyond the first housing wall 24.

Within the housing 12, the internal rotor 14 is floatingly mounted on the drive shaft 23 (see FIG. 11), as a result of which the internal rotor 14 is radially fixed in place.

In this embodiment, the axial mounting of the internal rotor 14 and of the external rotor 16 is also realized by the housing walls 24, 26.

Outside the housing 12, an intermediate pinion 46 is mounted on the drive shaft 23 for conjoint rotation.

The intermediate pinion 46 meshes with the drive pinion 20 so that a torque can be transferred from the electric motor 25 to the external rotor 16 via the intermediate pinion 46 and the drive pinion 20.

It is theoretically conceivable to provide a further intermediate pinion, which can be mounted for example on the first housing wall 24, or on the housing bottom 28.

The drive pinion 20 is therefore part of an at least two-stage gear mechanism.

As shown in FIG. 10 and in FIG. 12, the drive pinion 20 has a first toothing 48 and a second toothing 50 axially offset from the first toothing 48, wherein the first toothing 48 and the second toothing 50 have different numbers of teeth. In particular, the second toothing 50 has fewer teeth than the first toothing 48.

In the exemplary embodiment, the drive pinion 20 is manufactured in one piece, but manufacture in multiple parts is also conceivable.

The second toothing 50 of the drive pinion 20 extends into the housing 12, so that the second toothing 50 meshes with the external toothing of the external rotor 16.

Adjoining the second toothing 50 of the drive pinion 20 is a bearing journal 52, which in particular is moulded in one piece with the drive pinion.

The bearing journal 52 is radially mounted in the housing 12, as shown in FIG. 11. To this end, the housing 12 has a corresponding receptacle 54.

The invention claimed is:

1. A fluid pump comprising a housing, an internal rotor located in the housing, and an external rotor which surrounds the internal rotor, which is rotatably mounted in the housing and, together with the internal rotor, forms an internal gear ring pump, wherein the external rotor is provided with a toothing with which a drive pinion meshes, wherein the toothing of the external rotor is an internal toothing.

2. The fluid pump according to claim 1, wherein the drive pinion and the internal toothing of the external rotor form an internal gear pump.

3. The fluid pump according to claim 2, wherein a first housing wall, which adjoins the internal rotor, has a main inlet opening and a main outlet opening.

4. The fluid pump according to claim 1, wherein a first housing wall, which adjoins the internal rotor, has a main inlet opening and a main outlet opening.

5. The fluid pump according to claim 4, wherein the first housing wall has a bearing journal for the radial mounting of the internal rotor.

6. The fluid pump according to claim 1, wherein a second housing wall, which adjoins the internal toothing of the external rotor, of the housing has an additional inlet opening and an additional outlet opening, which at least partially overlap with the drive pinion.

7. The fluid pump according to claim 6, wherein, between the internal rotor and the internal toothing of the external rotor, there is an axial wall in the external rotor.

8. The fluid pump according to claim 7, wherein a second housing wall, which adjoins the internal toothing, of the housing has a sickle-shaped elevation between the internal toothing of the external rotor and the drive pinion.

9. The fluid pump according to claim 6, wherein a second housing wall, which adjoins the internal toothing, of the housing has a sickle-shaped elevation between the internal toothing of the external rotor and the drive pinion.

10. The fluid pump according to claim 1, wherein a first housing wall, which adjoins the internal rotor, has a main inlet opening and a main outlet opening.

11. The fluid pump according to claim 1, wherein a second housing wall, which adjoins the internal toothing of the external rotor, of the housing has an additional inlet opening and an additional outlet opening, which at least partially overlap with the drive pinion.

* * * * *